US006068181A

United States Patent [19]

Cai

[11] Patent Number: 6,068,181

[45] Date of Patent: May 30, 2000

[54] FRENCH FRY CARTON WITH HIDDEN INDICIA

[75] Inventor: Liming Cai, West Chester, Pa.

[73] Assignee: Dopaco, Inc., Exton, Pa.

[21] Appl. No.: 09/245,346

[22] Filed: Feb. 5, 1999

[51] Int. Cl.[7] ..... B65D 5/42

[52] U.S. Cl. ..... 229/116.1; 206/459.5; 206/431; 229/400; 229/906

[58] Field of Search ..... 206/459.5, 831; 229/116.1, 400, 906, 902; 40/312

[56] References Cited

U.S. PATENT DOCUMENTS

| | | | |
|---|---|---|---|
| 3,071,882 | 1/1963 | Eisman et al. | 40/312 |
| 3,099,381 | 7/1963 | Meyers | 206/459.5 |
| 3,183,614 | 5/1965 | Loderhose . | |
| 3,205,603 | 9/1965 | Brumley | 206/459.5 |
| 3,220,634 | 11/1965 | Rubinstein | 206/459.5 |
| 3,804,323 | 4/1974 | Bemel | 206/831 |
| 3,958,744 | 5/1976 | Herglotz | 206/831 |
| 4,004,691 | 1/1977 | Wihksne | 206/459.5 |
| 4,232,816 | 11/1980 | Johnson et al. | 206/831 |
| 4,252,264 | 2/1981 | Herbst et al. | 229/400 |
| 4,267,955 | 5/1981 | Struble . | |
| 4,326,665 | 4/1982 | Scott . | |
| 4,345,393 | 8/1982 | Price et al. . | |
| 4,410,129 | 10/1983 | Wischusen, III . | |
| 4,453,664 | 6/1984 | Oliff | 206/831 |
| 4,472,896 | 9/1984 | Brauner et al. . | |
| 4,729,477 | 3/1988 | Growney . | |
| 4,838,424 | 6/1989 | Petzelt . | |
| 4,872,555 | 10/1989 | Shadrach, III et al. . | |
| 5,007,578 | 4/1991 | Simone | 206/459.5 |
| 5,072,877 | 12/1991 | Van Fulpen . | |
| 5,074,462 | 12/1991 | Countee, Jr. . | |
| 5,341,923 | 8/1994 | Arasim . | |
| 5,474,183 | 12/1995 | Warren et al. . | |
| 5,690,273 | 11/1997 | Jensen . | |
| 5,697,549 | 12/1997 | Yocum . | |

*Primary Examiner*—Gary E. Elkins
*Attorney, Agent, or Firm*—Dennison, Scheiner, Schultz & Wakeman

[57] ABSTRACT

A french fry carton with front and rear face panels and a pair of overlay panels positioned over one of the face panels and including a pair of transversely aligned tear-out sections with partially concealed access tabs available only upon an erection of the carton from its folded stored position to its open in-use position, the tear-out sections providing for the selected disclosure of hidden prize or promotional materials.

12 Claims, 3 Drawing Sheets

FRENCH FRY CARTON WITH HIDDEN INDICIA

BACKGROUND OF THE INVENTION

Fast food cartons, particularly cartons formed of foldable sheet material such as paperboard, have frequently incorporated promotional materials, prizes, collectibles and the like.

It is preferred that such promotionals include a "surprise" factor wherein the award is not immediately known and requires some form of manipulation such as the unfolding or removal of a portion of the carton itself or a separate member affixed thereto.

Scoop-type french fry cartons have been found to be particularly adaptable for such promotional materials. In this regard, attention is directed to U.S. Pat. No. 5,697,549, commonly assigned with the present application.

Another form of known french fry carton utilizes a pair of opposed panels which partially overlie the rear face panel and include a pair of oppositely directed coupons, one in each of the overlaid panels and intended for only partial removal. Each of these coupons, in the folded carton, that is the flat carton as stored prior to use, includes a lifting corner which is exposed and extends laterally beyond the opposed side edges of the folded carton. So formed, the extended corners both increase the actual width of the folded carton and present exposed ends which can be accidentally engaged, resulting in a possible unintentional tearing of the coupon prior to the actual use of the carton. Additionally, in this known carton, the coupons extend across the full width of the folded side wall panels, thus forming, upon the partial removal of the coupons, two rather large holes in the carton through which the contents of the carton could fall. This known carton is erected from its folded to its use position by an upward and inward pressure on the bottom, forming a concave base with the side walls of the carton each formed by a pair of side panels terminating in an outermost linear side edge of the carton.

SUMMARY OF THE INVENTION

It is a primary object of the present invention to provide a french fry carton which, while providing opposed transverse tear-out sections in a pair of overlaid panels, does so in a manner which significantly improves over known prior art constructions.

The fry carton or scoop of the invention is erected from its folded storage and shipping position to its in-use or open position by inwardly flexing the opposed side walls, with the walls, under manual pressure, inwardly snapping toward each other to a stable position wherein the opposed front and rear walls are outwardly bowed and the scoop mouth of the carton opened. This can easily be achieved by a single hand lifting the folded carton and simultaneously inwardly flexing the opposed side walls, while the other hand readies the foodstuff, usually french fries, for introduction into the carton.

It is particularly significant that the carton be opened by inwardly flexing the opposed sides or side walls in that this erecting movement automatically exposes the opposed tab ends on two transversely aligned tear-off sections for easy access thereto by the consumer. In conjunction therewith, and of substantial significance, is the fact these tabs ends, in the folded carton prior to erection, are inwardly spaced from the outer side edges of the folded carton and are defined only partially within one of the side panels of each side wall so as to, in effect, be inaccessible in the folded carton and only accessible upon an erection or opening of the carton.

Another significant feature of the particular relationship between the inwardly bowed side walls and the tear-out sections is the minimizing of the openings formed upon a removal of the tear-out sections, thus allowing for a nondestructive or nondamaging removal of the tear-out sections prior to a consuming of the contents of the carton.

These and other features of the invention will become more apparent from the more detailed description following hereinafter.

DESCRIPTION OF PREFERRED EMBODIMENTS

Figures 1, 2, 3:
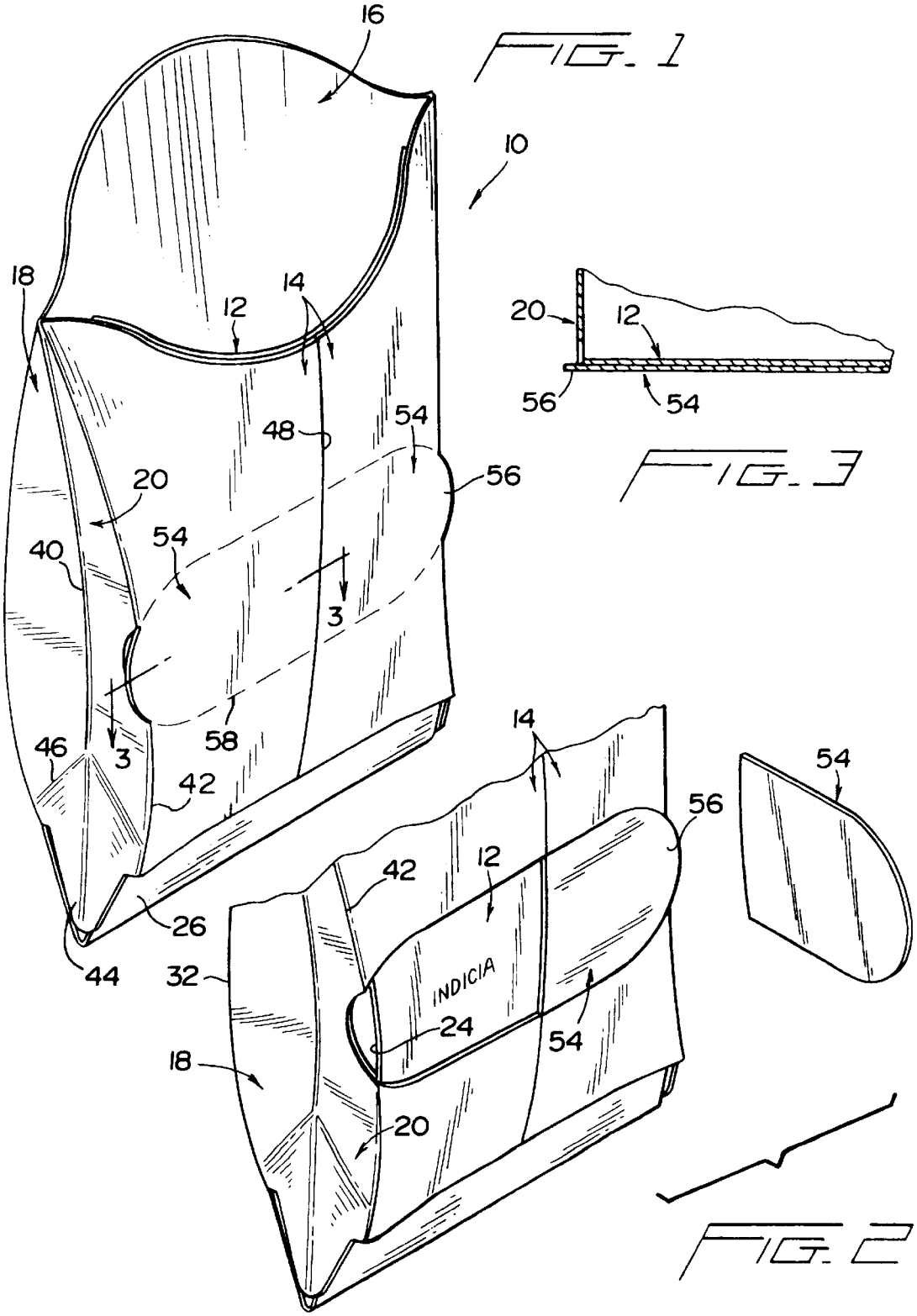
FIG. 1 is a perspective view of the carton of the invention in its open or in-use position.
FIG. 2 is a exploded partial perspective view illustrating the carton with one coupon removed.
FIG. 3 is a cross-sectional detail taken substantially on a plane passing along line 3—3 in FIG. 1.

Referring now more specifically to the drawings, FIG. 1 illustrates the carton 10 in its fully erected position ready to receive the foodstuffs, whether french fried potatoes, onion rings, or the like. The carton 10 includes a front wall formed by a front panel or face panel 12 and a pair of overlay panels 14, a rear wall formed of a single rear panel or face panel 16, and opposed side walls, each defined by a pair of side panels 18 and 20.

Figure 6:
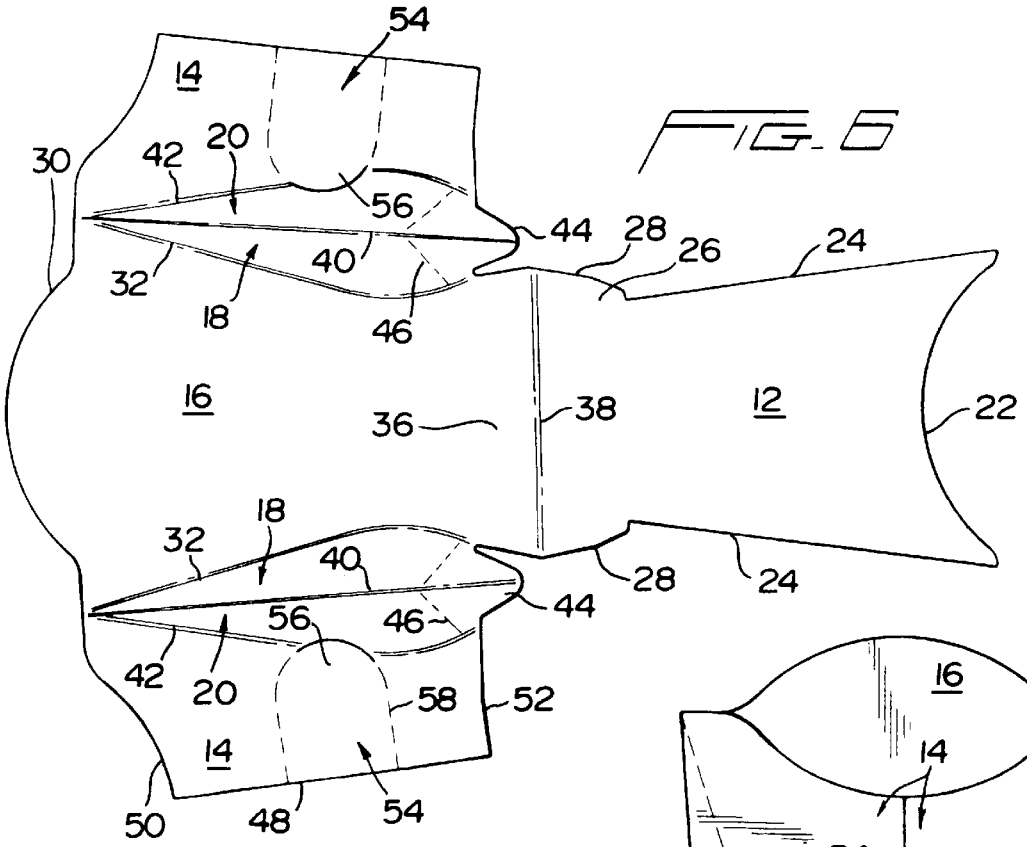
FIG. 6 is a plan view of the blank from which the carton is formed.

It is believed the actual construction of the carton will be best understood from a consideration of the blank of FIG. 6, in conjunction with FIGS. 1–5. For purposes of consistency, the panels in the blank have been designated by the same reference numerals used in defining these panels in the erected carton 10. The front panel 12 includes a concave upper or outer edge 22, normally provided to facilitate access to the contents of the carton. The opposed side edges 24 of the front panel 12 converge downwardly or inwardly from the opposed ends of the concave upper edge 22 and terminate in a laterally enlarged bottom forming section 26 with generally outwardly diverging side edge lengths 28.

The rear panel 16 is generally of the same height as the front panel 12, differing in that the outer edge 30 has a major portion which is outwardly convex and complementary to the concave outer edge 22 of the front panel 12. This outer or upper edge of the rear panel 16, longitudinally beyond the convex portion thereof, extends for a minor distance, thus providing an upper edge slightly longer than the upper edge of the front panel 12.

Fold lines 32 define the side edges, also 32, of the rear panel 16 and converge from the opposite ends of the outer edge 30 inwardly at a relatively greater angle than that of the converging side edges 24 of the front panel 12 with the converging edges 32 extending linearly for a major portion of the height of the rear panel 16 to arced portions which define the minimum spacing between the edges 32. The edges 32 terminate in outwardly diverging lower extents 34, to define a widened base portion 36 which substantially conforms to the base portion 26 of the front panel 12. These base portions 26 and 36, and hence the front and rear panels 12 and 16, are integrally formed with a full length transverse fold line 38 therebetween which allows for a folding of the front and rear panels 12 and 16 into overlying relation with each other in the formed carton.

The side panels 18 and 20 to each side of the rear panel 16 comprise inner and outer side panels respectively and relative to the rear panel side edges 32. The side panels 18 and 20 of each pair of side panels are mirror images of each other with a central longitudinal fold line 40 formed therebetween. A fold line 42 similar to fold line/edge 32 defines the outer edge of the outer side panel 20 whereat each outer side panel 20 is integral with one of the overlay panels 14. So formed, each pair of side panels 18 and 20, extending from the upper edge 30 of the rear panel 16 at the extreme ends thereof, enlarge downward to a maximum width just above the bottom section 36, providing in effect a narrow waist. The outer edges of the side panels 18 and 20, below the waist area, converge and define an extending flap 44 which extends substantially to the plane of the transverse fold line 38 between the front and rear panels to act as a closure for the opposed ends of the bottom of the opened carton as best seen in FIGS. 1 and 2.

The side wall defined by each pair of side panels 18 and 20 is completed by a pair of crease lines 46 which diverge downwardly from the central fold line 40 at a point slightly below the maximum width of the side panels and at an angle of approximately 45° to the respective side edge fold lines 32 and 42 at points slightly above the flap portion 44. So formed, the meeting of the crease lines 46 with the central fold line 40 define opposed pressure points, one in each of the side walls, whereat inward pressure can be applied to in effect pop open the folded carton with a simple one hand operation. Upon the application of such pressure, each pair of side panels curve arcuately inward along the full height thereof sufficiently as to move the center fold line 40 generally off center inwardly for a major portion of the height thereof from the upper edge of the carton to the point at which the crease lines 46 meet, thus avoiding an accidental outward popping of the side panels as may inadvertently collapse the carton. Simultaneously therewith, and as a means for stabilizing the inwardly deformed side wall panels, the crease lines 46 provide for a slight outward buckling of the side panels, below the crease lines 46, in a manner which locks the panels open and provides for a positive laterally inwardly directed force at the meeting of the crease lines 46 with the central fold line 40 which prevents an outward return of the central fold line 40 to the folded position.

The overlay panels 14 extend outward from the fold lines 42 and terminate in free outer edges 48 which, upon a lateral folding of the overlay panels and adjacent outer side panels 20 about the side panel fold lines 40, lie in immediately adjacent parallel relation to each other vertically along the outer face of the front panel 12. These overlay panels 14 are appropriately bonded to the front panel 12. The upper edge 50 of each of the overlay panels 14 includes a concave arc therein which conforms to the arc the concave upper edge 22 of the front panel 12 whereby upon overlaying the two overlay panels 14, the upper edges 50 together conform to the upper edge 22. The lower edge 52 of each of the overlay panels 14 is positioned in general alignment with the upper area of the bottom portion 36 of the rear panel 16, and hence also the bottom portion 26 of the front panel 12 with the flap 44 extending therebeyond or therebelow.

The carton 10 is provided with a transversely aligned pair of tear-off sections 54, preferably at slightly below mid-height in the overlay panels 14. Noting the blank, these sections extend inward, in each overlay panel 14, from the outer edge thereof to an inner tab portion or end 56 extending only slightly inward of the adjacent side panel 20 and terminating well short of the side panel fold line 40. Each of the tear-off sections is defined by a peripheral severance line 58 of perforations or the like which allow for an easy severing of the section 54 from the corresponding overlay panel 14. The tab portion 56 of the section 54 is preferably defined by a cut line wherein this tab portion is free of the corresponding outer side panel 20 from which it is formed. Each tear-out section 54 will preferably be free of adhesive bonding to the underlying front panel 12 to allow for complete removal notwithstanding the effective bonding of the remainder of the overlay panel 14 to the front panel 12.

Figure 4:
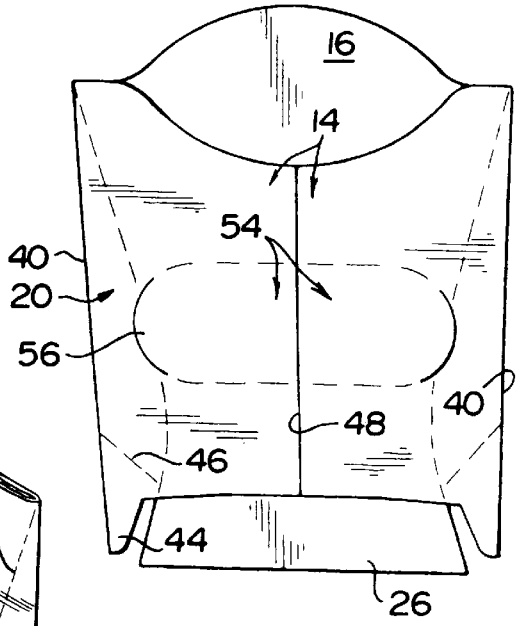
FIG. 4 is an elevational view of the carton in its folded position.

As will be best seen in FIG. 4, illustrating the folded carton prior to opening for use, the tabs 56 of the tear-out sections 54 are well within the side edges as defined by the fold lines 40 between the side panels 18 and 20 of each pair side panels. As such, and as these tab portions are defined completely within the plane of the adjacent outer side panels 20, there are no projecting edges by which the tear-out sections 54 might accidently be torn, nor are any gaps or openings provided. The tear-out sections 54 are rather effectively concealed and generally inaccessible in the folded carton as in FIG. 4. However, upon an engagement of the opposed side walls at the defined pressure points, and an inward deflecting of the side walls, the carton expands to its open or in-use position and the tab portions 56, fully severed from the corresponding side panels 20 now project a slight distance laterally outward for free and easy access thereto. Thus, it is only when the carton is to actually receive the foodstuff, that the tear-out sections are readily available to the customer.

Figure 5:
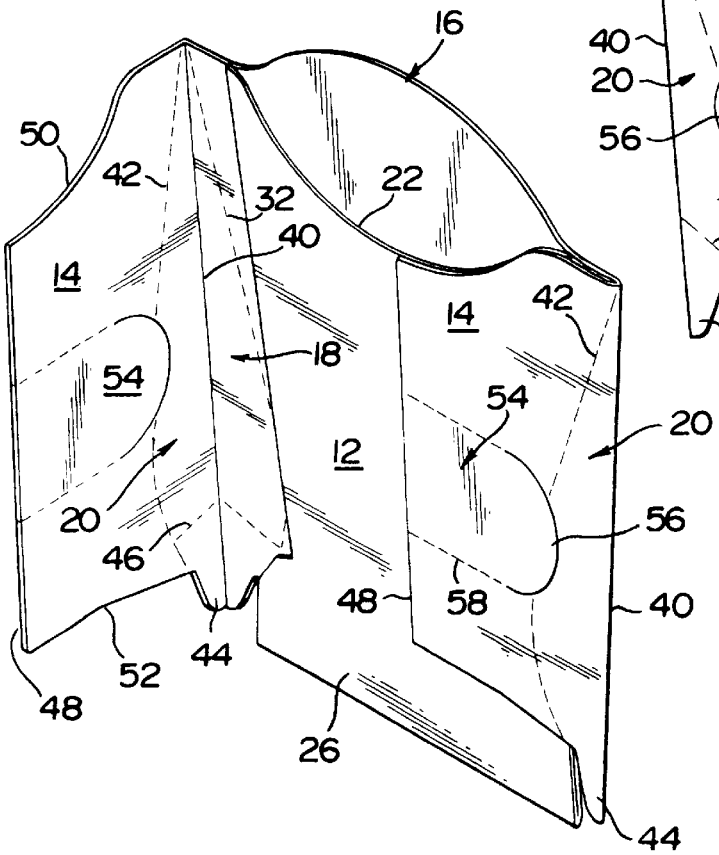
FIG. 5 is a prespective view of the folded carton with an overlay panel open.

With reference to FIG. 5, it will be seen that in the folded position of the carton, each front panel side edge 24 meets the fold line forming inner edge 32 of the rear panel 16 at a point slightly below the tear-out section 54 and closely adjacent to the area of maximum width of the pair of panels 18 and 20. Thus, and noting FIG. 2 in particular, a removal of a tear-out section 54, while disclosing the outer face of the front panel 12, along with any promotional material thereon, will provide only a minimal opening to the interior of the carton, substantially no more than the slight notch defined by the tab 56 of the tear-out section 54. It is to be appreciated that the inward flexing or deformation of the opposed pairs of side panels, in addition to providing for the automatic opening of the carton, also minimize the possibility of any significant opening being provided upon a removal of the tear-out sections in that the inwardly flexed side panels, particularly as the outer side panels 20 along fold line 42 closely follow the corresponding outwardly bowed edges 24 of the front panel 12 as this front panel is outwardly bowed in the open carton.

The tear-out sections 54 are intended to be removable in their entirety, with the perforated lines 58 extending to the outer edges 48 of the overlay panels 14. Such a complete removal of the sections in no way affects the integrity of the carton insofar as retaining the contents. Further, promotional material can be provided on either or both of the outer face of the front panel 12 and inner faces of the removable sections 54. The provision of dual removable sections allows for a variety of different types of promotions, including the matching of the hidden indicia on one side with hidden indicia on the other side as a determination as to whether a prize is to be awarded.

Figure 7:
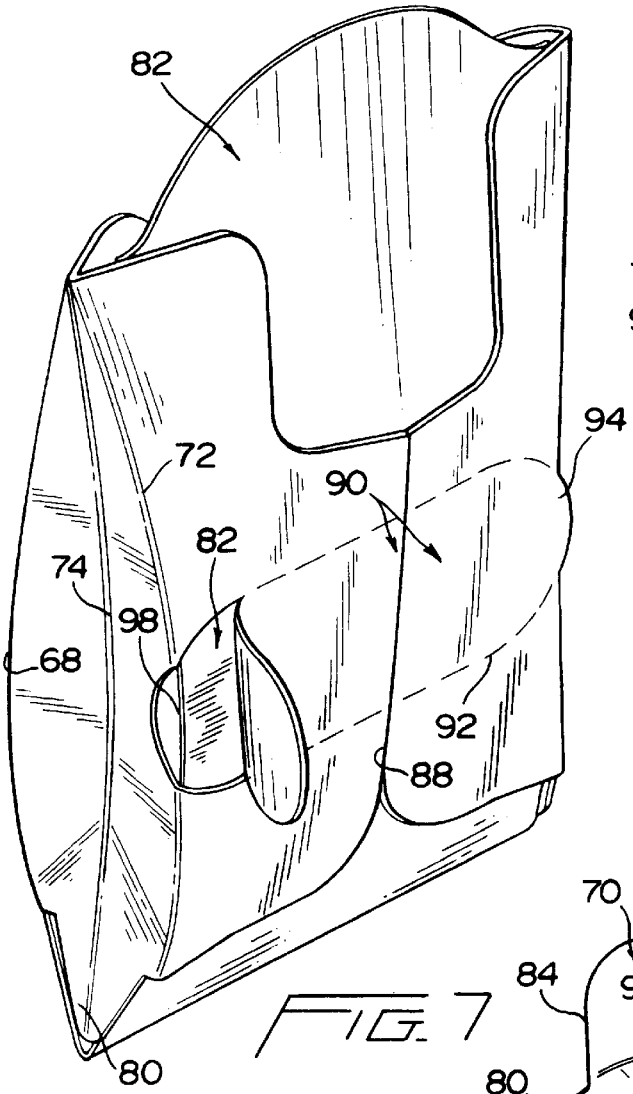
FIG. 7 is a perspective view of a variation of the carton with one of the coupons partially peeled therefrom.
Figure 8:
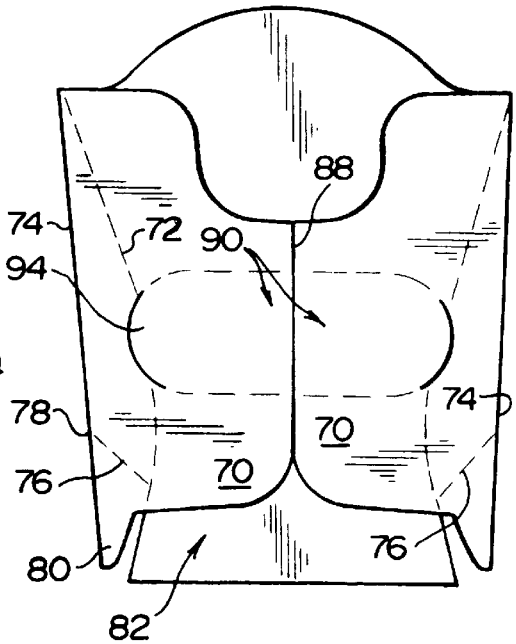
FIG. 8 is a plan view of the carton of FIG. 7 in its folded or storage position.
Figure 9:
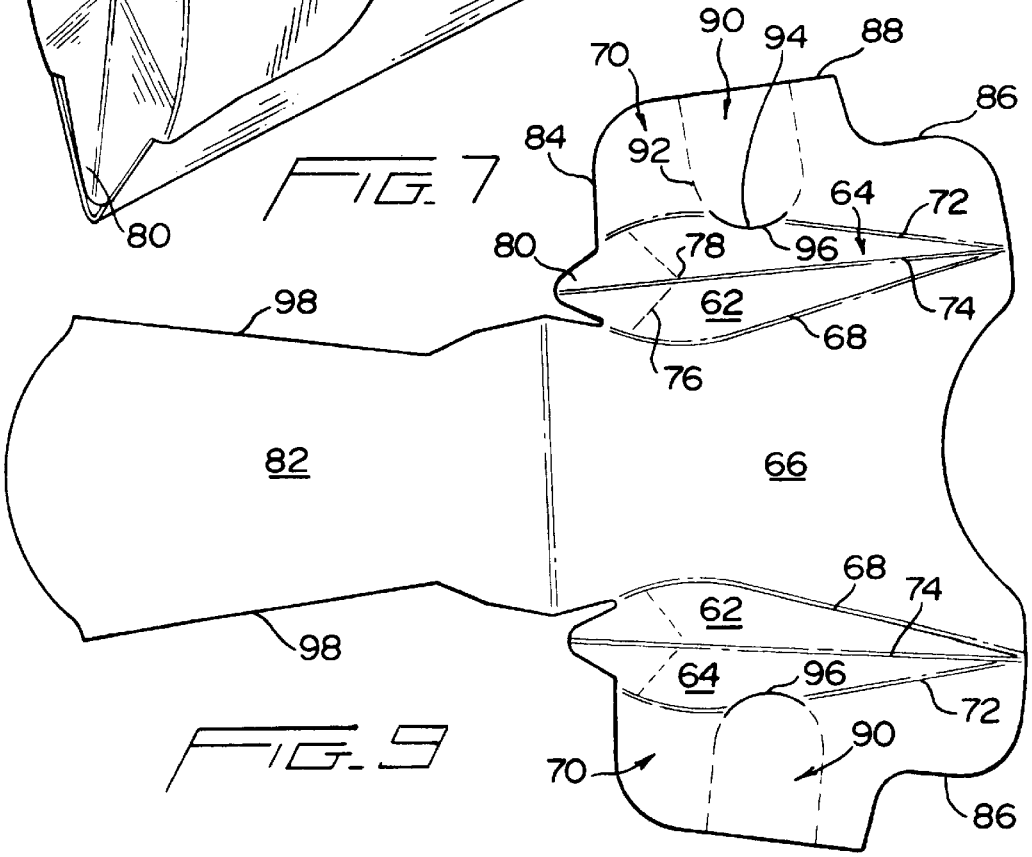
FIG. 9 is a plan view of the blank from which the carton of FIG. 7 is formed.

FIGS. 7–9 illustrate a variation wherein the carton 60 has the opposed pairs of side panels 62 and 64 integral with the opposed edges of the front panel 66 along fold lines 68. The overlay panels 70, as in the first embodiment, are integral with the outer edges of the outer side panels 64 along fold lines 72.

Each pair of side panels 62 and 64 is configured in the same manner as the previously described side panels 18 and 20, and include a full height central edge-forming fold line 74, inwardly diverging crease lines 76 defining a pressure point 78, and a lower closure flap or flap portion 80.

The overlay panels 70 overlay the outer face of the rear panel 82 and meet along the vertical center line thereof. These overlay panels 70, have lower edges 84 thereof positioned, in the erected carton 60, above the slightly diverging bottom portions of the front and rear panels 66 and 82, also as previously described. The upper edges 86 of the overlay panels 70 include rather deep recesses inward of the free outer edges 88 thereof to minimize the amount of material required to provide a stable carton.

The tear-out sections 90, extend from the free outer edges 88 of the overlay panels 70, generally centrally between the upper edge notch and the lower edge 84, transversely across the overlay panels where each section 90 is defined by a perforated severance line or the like 92 with the extreme end of each tear-out section formed within a minor portion of the adjacent outer side panel 64 to provide a tab 94 defined by an arcuate cut line 96 which terminates substantially inward of the outer side edges of the folded carton, as in FIG. 8, defined by the side panel central fold lines 74.

As in the previously defined embodiment, engagement with the opposed pressure points at the juncture of the side panel crease lines 76 and central fold line 74, and an inward pressure thereat, will inwardly deform the side panels, producing a corresponding outward bowing of the front and rear panels relative to each other, and a simultaneous inward offsetting of the outer side panels 64 from the tabs 94 of the tear-out sections 90 for easy access thereto only when the carton is ready to receive the foodstuffs. Noting FIG. 7, the resultant opening left by the removal of a tear-out section 90 is minimal in light of the close conformance of the opposed side edges 98 of the rear panel 82 and the bowed edge of the corresponding outer side panel 64 defined by fold line 72.

As with the first described embodiment, the access tabs 94 for the tear-out sections 90 are substantially concealed and inaccessible until such time as the carton is to be filled and handed to the customer. The formed crease lines 76, as with the previously described crease lines 46, provide for an outward offsetting of the lower portions of the side panels 62 and 64 as these side panels are inwardly flexed to counteract any tendency for the side panels to outwardly return to the folded position thereof.

While two embodiments of the invention have been set forth in detail above, it is to be appreciated that other embodiments as may occur to those skilled in the art are to be considered within the scope of the claims following hereinafter.

I claim:

1. A carton of foldable sheet material comprising first and second overlying face panels with joined lower edge portions, said face panels having opposed side edges, a pair of inner and outer side panels along each side edge of said first face panel, said inner and outer side panels of each pair of side panels being integral with a full length fold line defined therebetween, each inner side panel being integral with said first face panel along the corresponding side edge thereof with an inner fold line defined along said corresponding side edge, each outer side panel having an outer edge with an overlay panel integrally extending therefrom and foldable relative to the outer side panel along an outer fold line defined along said outer edge of the outer side panel, each of said overlay panels overlying and being at least partially bonded to said second face panel, said overlay panels having outer edges positioned generally adjacent each other centrally of said second face panel, a pair of tear-out sections, one extending transversely across each of said overlay panels and extending inward from the outer edge thereof, lines of severance defining each tear-out section in each overlay panel, each tear-out section further including a tab end defined from a portion of the adjacent outer side panel extending from said outer fold line to a point spaced from said central fold line and remote from the corresponding inner side panel.

2. The carton of claim 1 wherein said carton has a first folded position for storage purposes, and a second open position for use, said carton, in said folded position, having opposed outer side edges defined by said central fold lines with said outer side panels being coplanar with said overlay panels and with said tear-out section tab ends defined within and coplanar with the outer side panels and terminating inward of the opposed outer side edges of the folded carton.

3. The carton of claim 2 wherein said carton, in said second open position, has the side panels of each pair of side panels extending transversely of and between said first and second face panels, each of said tear-out section tab ends extending beyond the corresponding pair of side panels at substantially right angles thereto and in a common plane with the overlay panels.

4. The carton of claim 3 wherein each pair of inner and outer side panels defines a carton side wall which, in the second open position of the carton, is inwardly deflected and generally concave along a longitudinal axis defined by the central fold line.

5. The carton of claim 4 wherein each side wall includes a pair of crease lines diverging from said central fold line, at a point below said tab end, downward to said inner and outer fold lines wherein a reversibly foldable portion is defined for stabilization of the said side walls in said second position of said carton.

6. The carton of claim 5 wherein said first and second face panels extend below said overlay panels and terminate in integral lower edges with a transverse fold line defined therealong, each of said side walls, defined by a pair of inner and outer side panels, including a depending generally triangular flap extending below said overlay panels to approximately said transverse fold line between said lower edges of said face panels.

7. The carton of claim 6 wherein said inner and outer fold lines of the side panels of each side wall, in said second open position, arc outwardly relative to each other with a maximum width defined therebetween at a point below said tear-off sections.

8. The carton of claim 7 wherein said side edges of said second face panel, in said second open position, are generally coextensive with said outer fold lines.

9. The carton of claim 8 wherein said second face panel has a concave upper edge, said overlay panels having upper edges which, in combination, conform to said concave upper edge of said second face panel.

10. A blank for use in the formation of a folded carton with tear-out sections, said blank including first and second aligned and coplanar face panels with a transverse fold line defined therebetween, said first face panel having opposed side edges, a first inner side panel substantially coextensive with and integral along each side edge with an inner fold line defined therealong, each inner side panel having an outer edge with an outer side panel integral therewith and with a central fold line defined therebetween, each said outer side panel having an outer edge with an overlay panel integral therewith and with an outer fold line defined therebetween, each of said overlay panels having a tear-out section defined therein and extending transversely inward from an outer edge thereof generally centrally therealong, each tear-out section extending across the corresponding overlay panel and being defined therefrom by severance lines, each tear-out section extending beyond the corresponding outer fold line and partially into the corresponding outer side panel to define a tab portion terminating in spaced relation to the corresponding central fold line between the corresponding inner and outer side panels.

11. The blank of claim 10 wherein said face panels have outer edges remote from said transverse fold line therebetween, said inner and outer fold lines of each pair of inner and outer side panels diverging inward from the outer edge of said first face panel and following a slightly arcuate path, defining a maximum width between corresponding inner and outer fold lines at a point beyond said tear-out section relative to said outer edge.

12. The blank of claim 11 wherein said inner and outer side panels to each side of said first face panel, including coplanar flaps extending inward beyond said overlay panels into approximate alignment with said transverse fold line between said face panels.

* * * * *